US010016010B2

(12) United States Patent
Horner et al.

(10) Patent No.: US 10,016,010 B2
(45) Date of Patent: Jul. 10, 2018

(54) HOOD LOCK CORD SYSTEM

(71) Applicant: NIKE, Inc., Beaverton, OR (US)

(72) Inventors: Stewart D. Horner, Portland, OR (US); Luke A. Pezzimenti, Portland, OR (US)

( * ) Notice: Subject to any disclaimer, the term of this patent is extended or adjusted under 35 U.S.C. 154(b) by 0 days.

(21) Appl. No.: 15/231,206

(22) Filed: Aug. 8, 2016

(65) Prior Publication Data

US 2017/0105471 A1 Apr. 20, 2017

Related U.S. Application Data

(60) Provisional application No. 62/242,742, filed on Oct. 16, 2015, provisional application No. 62/242,778, filed on Oct. 16, 2015.

(51) Int. Cl.

| | |
|---|---|
| ***A42B 7/00*** | (2006.01) |
| ***A41D 1/04*** | (2006.01) |
| ***A42B 1/04*** | (2006.01) |
| ***A42C 1/00*** | (2006.01) |
| ***A41D 27/00*** | (2006.01) |

(52) U.S. Cl.

CPC ..... *A42B 7/00* (2013.01); *A41D 1/04* (2013.01); *A41D 27/00* (2013.01); *A42B 1/048* (2013.01); *A42C 1/00* (2013.01); *A41D 2200/20* (2013.01)

(58) Field of Classification Search

CPC .. A41D 27/00; A41D 1/04; A42B 7/00; A42B 1/008; A42B 1/048

USPC ..... 2/84, 88, 85, 94, 87, 202, 271, 108

See application file for complete search history.

(56) References Cited

U.S. PATENT DOCUMENTS

| | | | |
|---|---|---|---|
| 1,525,322 | A | 2/1925 | Post |
| 2,150,171 | A | 3/1939 | Kolly |
| 2,160,682 | A | 5/1939 | Silber |
| 2,170,339 | A | 8/1939 | Reeves |
| 2,264,314 | A | 12/1941 | Edmund |
| 3,045,243 | A | 7/1962 | Lash et al. |
| 3,698,014 | A | 10/1972 | Cebula |
| 5,274,850 | A | 1/1994 | Aldridge |
| 6,654,963 | B2 | 12/2003 | Fayle et al. |
| 6,665,878 | B1 | 12/2003 | Way |
| 6,874,162 | B2 | 4/2005 | Boezi |
| 7,380,286 | B1 | 6/2008 | Bryant, Sr. |

(Continued)

FOREIGN PATENT DOCUMENTS

| | | | |
|---|---|---|---|
| DE | 847733 | C | 8/1952 |
| FR | 2784868 | A1 | 4/2000 |

(Continued)

OTHER PUBLICATIONS

"Rondoy Down Jacket: K Series," PHD, phdesigns.co.uk, Accessed: Jul. 2015. http://www.phdesigns.co.uk/rondoy-down-jacket-k-series.

(Continued)

*Primary Examiner* — Gloria Hale

(74) *Attorney, Agent, or Firm* — Shook, Hardy & Bacon L.L.P.

(57) ABSTRACT

An apparel item having a cord lock for restricting the movement of a hood on an article of apparel. The cord lock may have a first end, a second end, and an intervening portion. The cord lock may be positioned on an outer-facing surface of a back panel of the apparel item proximate to a neckline area of the apparel item.

19 Claims, 6 Drawing Sheets

(56) References Cited

U.S. PATENT DOCUMENTS

| | | | | |
|---|---|---|---|---|
| 7,779,485 | B2 | 8/2010 | Gandy | |
| 8,438,665 | B2 | 5/2013 | Roemer et al. | |
| 2007/0118960 | A1 | 5/2007 | Goodwin | |
| 2009/0144884 | A1* | 6/2009 | Duncan | A42B 1/008 2/410 |
| 2011/0131704 | A1 | 6/2011 | Hughes | |
| 2011/0185482 | A1 | 8/2011 | Godfrey et al. | |
| 2011/0225699 | A1 | 9/2011 | Elhamsadat et al. | |
| 2013/0269082 | A1 | 10/2013 | Bramblet | |
| 2014/0338092 | A1 | 11/2014 | Kinsey | |

FOREIGN PATENT DOCUMENTS

| | | | |
|---|---|---|---|
| FR | 2820000 | A1 | 8/2002 |
| JP | S61199517 | U | 12/1986 |
| JP | H02131515 | U | 11/1990 |
| JP | 2011117121 | A | 6/2011 |
| JP | 2012255242 | A | 12/2012 |
| JP | 2013122095 | A | 6/2013 |
| WO | 2013171477 | A1 | 11/2013 |

OTHER PUBLICATIONS

International Search Report and Written Opinion dated Aug. 3, 2016 for International Patent Application No. PCT/US2016/018708, 19 pages.

International Search Report and Written Opinion dated Nov. 15, 2016 for International Patent Application No. PCT/US2016/047076, 13 pages.

International Search Report and Written Opinion dated Nov. 16, 2016 for International Patent Application No. PCT/US2016/055100, 14 pages.

International Preliminary Report on Patentability dated Aug. 31, 2017 in International Patent Application No. PCT/US2016/018708, 13 pages.

International Preliminary Report on Patentability dated Sep. 29, 2017 in International Patent Application No. PCT/US2016/55100, 19 pages.

* cited by examiner

HOOD LOCK CORD SYSTEM

CROSS-REFERENCE TO RELATED APPLICATIONS

This application Ser. No. 15/231,206, and entitled "Hood Lock Cord System," claims priority to U.S. Prov. App. No. 62/242,742, entitled "Hood Lock Cord System," which was filed on Oct. 16, 2015, and U.S. Prov. App. No. 62/242,778, entitled "Cold-Weather Apparel Item," which was filed on Oct. 16, 2015. The entireties of the aforementioned applications are incorporated by reference herein.

FIELD OF THE INVENTION

The present disclosure relates to a hood lock cord system for restricting the movement of a hood on an article of apparel.

BACKGROUND

Traditional apparel items for cool or cold-weather athletic activities, such as jackets or coats, are generally configured to be lightweight yet durable enough to protect a wearer from the elements. These apparel items may feature a hood to provide additional warmth or protection from the elements, where the hood is generally attached to a neckline area of the apparel item. However, when the hood is not in use and is in a down position, it may distract the wearer during athletic activities by swinging back-and-forth, and/or by flapping or bumping against the back panel of the apparel item. Some athletic activities likely to produce this kind of movement include, for example, running, jumping, and the like. These types of movements by the hood may cause the wearer frustration, distraction, and a possible decrease in athletic performance.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The present invention is defined by the claims.

At a high level, aspects herein are directed toward an apparel item with a hood, such as a jacket or coat, having a hood lock cord system for restricting the movement of the hood when the hood is not in use. The hood lock cord system is generally formed from a cord having a first end, a second end, and an intervening portion extending between the two ends. In exemplary aspects, the ends of the cord may be secured adjacent to a neckline of the apparel item. More specifically, the ends may be generally secured to an outer-facing surface of a back panel of the apparel item adjacent to the neckline of the apparel item such that the intervening portion of the cord extends across a midline of the back panel. When the hood is not being used, the hood may be secured underneath the cord thereby preventing the hood from moving during vigorous activities such as, for example, running, jumping, biking, and the like. In one exemplary aspect, the first and second ends of the cord are received and secured to the back panel of the apparel item by a first and a second anchoring portion. In turn, the first and second anchoring portions may be secured in a seam joining, for example, the back panel and the hood, and/or in seams joining right and left sleeves to the back panel. The positioning of the first and second ends of the cord below the neckline may be variable dependent on the size of the garment and/or the size of the hood.

In accordance with aspects hereof, the cord may have elastic properties for facilitating easier securing of the hood when not in use. In another exemplary aspect, the cord of the hood lock cord system may have a rubber or plastic sheath for protecting the structural integrity of the cord, while additionally providing decreased friction between the hood of the apparel item and the cord when adjusting the hood to the secured position. Moreover, the dimensions of the hood cord lock system, such as the diameter of the cord, the cross-sectional shape of the cord, and/or the length of the cord, may be variable, and all such lengths, diameters, and/or shapes of the cord are contemplated herein.

Aspects herein may further relate to a method of manufacturing an apparel item having a hood lock cord system. The method may comprise, for example, providing a front panel and a back panel, and affixing the front and back panels together at one or more seams to create at least a neckline opening between the front panel and the back panel. Continuing, the method may further comprise affixing a hood to the neckline opening. A cord having a first end, a second end, and an intervening portion may be positioned proximate to the neckline opening on an outer-facing surface of the back panel such that the first end is positioned on a first lateral side of the back panel proximate the neckline opening, the second end is positioned on a second lateral side of the back panel proximate the neckline opening, and the intervening portion of the cord extends across a midline of the back panel. The cord may then be secured to the back panel by, for example, securing the first end of the cord in a seam joining a right sleeve to the apparel item and securing the second end of the cord in a seam joining a left sleeve to the apparel item. Alternatively, the first and second ends may be secured in the seam joining the hood to the apparel item.

BRIEF DESCRIPTION OF THE DRAWINGS

Examples of the present invention are described in detail below with reference to the attached drawing figures, wherein.

DETAILED DESCRIPTION

Figure 2:
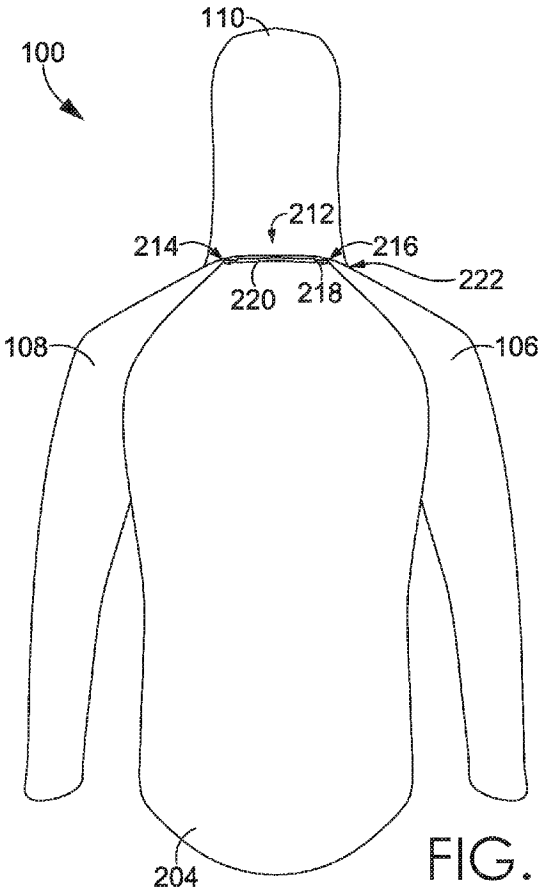
FIG. 2 illustrates a back view of the exemplary apparel item having the hood lock cord system of FIG. 1 in accordance with an aspect herein.

The subject matter of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

Aspects herein relate to an apparel item with a hood, such as a jacket or coat, having a hood lock cord system for restricting the movement of the hood when the hood is not being worn by a wearer. The hood lock cord system may comprise a cord having a first end, a second end, and an intervening portion extending between the two ends. The first and second ends of the cord may be secured on an outer-facing surface of a back panel of the apparel item adjacent to a neckline area of the apparel item. More particularly, the first and second ends may be secured on either side of a midline of the back panel such that the intervening portion of the cord extends across the midline of the back panel. The positioning of the hood lock cord system relative to the neckline of the apparel item may be variable dependent on the size of the apparel item and/or the size of the hood.

In one aspect, the first and second ends of the cord may be secured to the back panel by a first and second anchoring portion. In exemplary aspects, the first anchoring portion may be secured at a first seam formed between the back panel and a right sleeve portion, and the second anchoring portion may be secured at a second seam formed between the back panel and a left sleeve portion. In another exemplary aspect, the first and second anchoring portions may be secured at a seam formed between the back panel and the hood of the apparel item.

It is contemplated herein that the hood lock cord system may permit a wearer to easily secure the hood out of the way while wearing the apparel item, in order to prevent the hood from moving during motion of the wearer. In one exemplary aspect, the movement of the hood may be restricted by adjusting the hood to a downward position and positioning the hood beneath the cord of the hood lock cord system. Moreover, it is contemplated herein that the hood lock cord system may further permit the wearer to easily access and don the hood when needed.

In aspects hereof, the properties of the cord may vary for facilitating the ease of use of the hood lock cord system. For example, the cord may be formed of an elastic material allowing the cord to be stretched while inserting the hood beneath the cord and to subsequently return to its original length to provide secure storage for the hood. As well, in one aspect, the length of the cord may be variable between, for example, 5 cm and 20 cm, dependent on the size of the apparel item and/or the size of the hood, although lengths greater than or less than these values are contemplated herein. In another aspect, the positioning of the cord below the neckline may be variable. For example, the cord may be positioned anywhere from 0.5 cm to up to 10 cm below the neckline area of the apparel item although distances greater than this or less than this are contemplated herein. In yet another aspect, the cord may further comprise a rubber or plastic sheath for protecting the structural integrity of the cord, while additionally providing decreased friction between the hood of the apparel item and the cord when adjusting the hood to the secured position.

Aspects herein further relate to methods of manufacturing an apparel item having a hood lock cord system. In an exemplary aspect, the apparel item may be formed by providing a front panel, providing a back panel, and then affixing the front panel to the back panel to form the apparel item. Once affixed, the front and back panels may define at least a neckline opening. The method may further comprise securing a hood to the neckline opening. A cord having a first end, a second end, and an intervening portion between the first and second ends may be positioned proximate to the neckline opening on an outer-facing surface of the back panel. In one exemplary aspect, the first and second ends of the cord may be secured to the back panel by securing the ends in a seam between a right and left sleeve panel and the back panel. In another exemplary aspect, the first and second ends of the cord may be secured in a seam between a hood and the back panel. Additional ways of securing the cord to the back panel are further contemplated herein.

Figure 1:
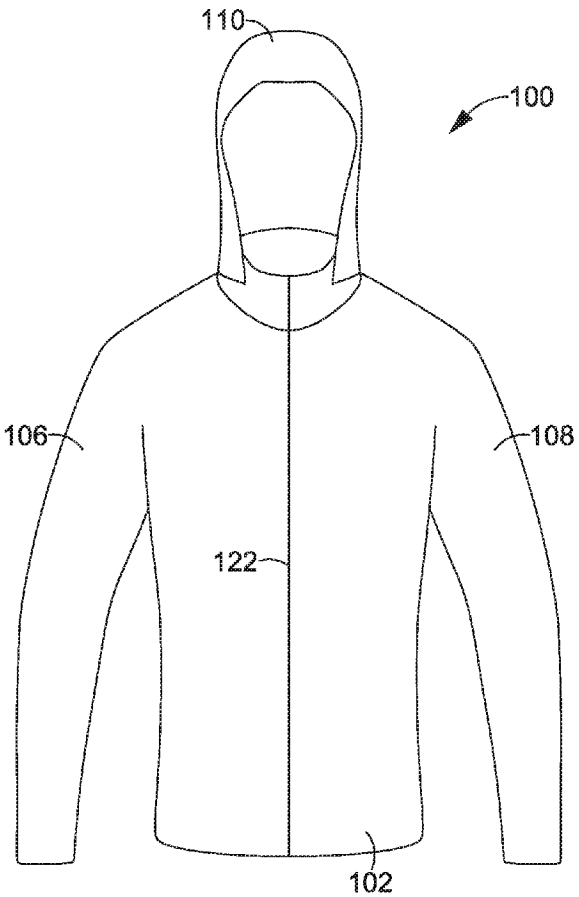
FIG. 1 illustrates a front view of an exemplary apparel item having a hood lock cord system where the apparel item's hood is in an upright position in accordance with an aspect herein.

Turning now to FIG. 1, a front view of an exemplary apparel item 100 having a hood lock cord system is depicted, in accordance with an aspect herein. While aspects discussed herein generally refer to jackets or coats, it will be understood that aspects are not limited to any particular apparel item, but rather, may be applied to any apparel item having a hood. Further, the depictions in the drawings are for exemplary purposes only and are in no way meant to limit the scope of the present invention. For instance, although the apparel item 100 is shown as a jacket, apparel item 100 may comprise a hooded shirt or sweatshirt, or any other type of apparel having a hood.

As shown in FIG. 1, the apparel item 100 comprises a front panel 102, a right sleeve 106, a left sleeve 108, and a hood 110 shown in an upright position. The front panel 102, in exemplary aspects, may comprise a front right panel and a front left panel that may be releasably secured to each other via, for instance, a zipper-type mechanism 122.

The apparel item 100 may be donned by a wearer by adjusting the zipper 122 to an unsecured position. From there, a wearer may insert his or her arms into the apparel item 100. However, in other aspects, such as when the apparel item 100 may comprise a hooded sweatshirt, the apparel item 100 may be donned by pulling the apparel item 100 over the head of a wearer.

FIG. 2 illustrates a back view of the exemplary apparel item 100 of FIG. 1, in accordance with an aspect herein. The apparel item 100 shown in FIG. 2 comprises a back panel 204 to which a hood lock cord system 212 is affixed proximate to a neckline 222. Further, as shown in FIG. 2, the hood 110 is affixed to the back panel 204 at the neckline 222.

In exemplary aspects, the hood lock cord system 212 comprises a first anchoring portion 214, a second anchoring portion 216, and a cord 218, which may further comprise a sheath 220. A close-up view of the hood lock cord system 212 is shown in FIG. 7.

Figure 7:
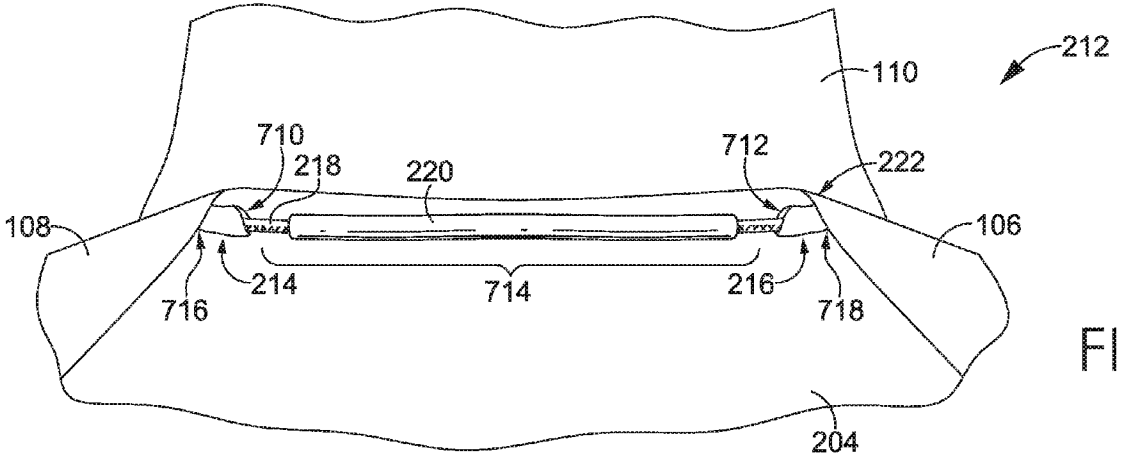
FIG. 7 illustrates the exemplary hood lock cord system of FIG. 1 in accordance with an aspect herein.

FIG. 7 shows the hood lock cord system 212 comprising the cord 218, where the cord 218 comprises a first end 710 secured in the first anchoring portion 214, a second end 712 secured in a second anchoring portion 216, and an intervening portion 714 extending between the first end 710 and the second end 712. As shown in FIG. 7, the intervening portion 714 of the cord 218 extends across a midline of the back panel 204.

The cord 218 may, in exemplary aspects, be formed from materials having some degree of elasticity such as rubber, spandex, thermoplastic polyurethane (TPU), etc. According to aspects herein, the length of the cord 218 may be variable between 5 cm and 20 cm dependent on the size of the apparel item 100 and/or the size of the hood 110, although lengths greater than or less than these values are contemplated herein. Additionally, the cord 218 may be positioned between 0.5 to 10 cm below the neckline 222 of the apparel item 100, although distances above and below these values are contemplated herein. In exemplary aspects, the cross-sectional shape of the cord 218 may comprise at least one of a circular, triangular, square, or a non-symmetrical shape. Further, the cross-sectional shape of the cord 218 and/or the cord's diameter may vary from the first anchoring portion 214 to the second anchoring portion 216.

In accordance with aspects hereof, the cord 218 may further comprise the rubber or plastic sheath 220. In exemplary aspects, the sheath 220 encases the cord 218 substantially along the length of the cord 218 and is configured to rotate freely around the cord 218. The sheath 220 may be made of a material such as rubber, plastic, polyurethane, thermoplastic polyurethane, silicone, and the like. The materials used to form the sheath 220 are generally selected to have a lower coefficient of friction than the cord 218. And because of its lower coefficient of friction, the sheath 220 provides decreased friction between the hood 110 of the apparel item 100 and the cord 218 when adjusting the hood 110 to the downward or secured position and/or when removing the hood 110 from the hood lock cord system 212 and positioning the hood 110 in a worn position. Moreover, because the sheath 220 is able to rotate freely around the cord 218, the hood 110 may be more easily inserted and drawn down under the cord 218 or withdrawn from under the cord 218.

In exemplary aspects, and as shown in FIG. 7, the first anchoring portion 214 may be secured at a seam 716 between the back panel 204 and the left sleeve 108, and the second anchoring portion 216 may be secured at a seam 718 formed between the back panel 204 and the right sleeve 106 of the apparel item 100. In exemplary aspects, the first and second anchoring portions 214 and 216 may be formed of a pliable material such that when the first and second anchoring portions 214 and 216 are secured in the seams 716 and 718, the first and second anchoring portions 214 and 216 do not cause significant displacement or disruption of the seams 716 and 718 as opposed to, for instance, directly securing the less-deformable first and second ends 710 and 712 of the cord 218 in the seams 717 and 718. In one exemplary aspect, the first and second anchoring portions 214 and 216 may be formed of a fabric material, a rubber material, a polyurethane or thermoplastic polyurethane material, and the like. In accordance with aspects herein, the first end 710 of the cord 218 may be affixed or secured within the first anchoring portion 214, and the second end 712 of the cord 218 may affixed or secured within the second anchoring portion 216 through the use of mechanical pressure, stitching, adhesives, bonding, and the like.

Figure 8:
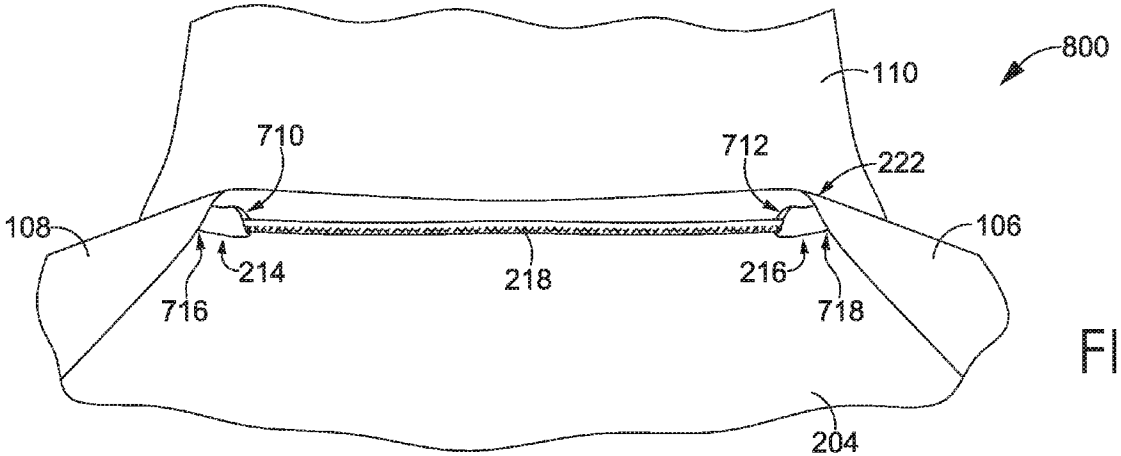
FIG. 8 illustrates an alternative configuration for an exemplary hood lock cord system in accordance with an aspect herein.

FIG. 8 illustrates an alternative configuration, referenced generally by the numeral 800, where the hood lock cord system 212 does not include the sheath 220 covering or encasing the intervening portion 714 of the cord 218. Any and all aspects, and any variation thereof, are contemplated as being within the scope of this disclosure.

Figure 9:
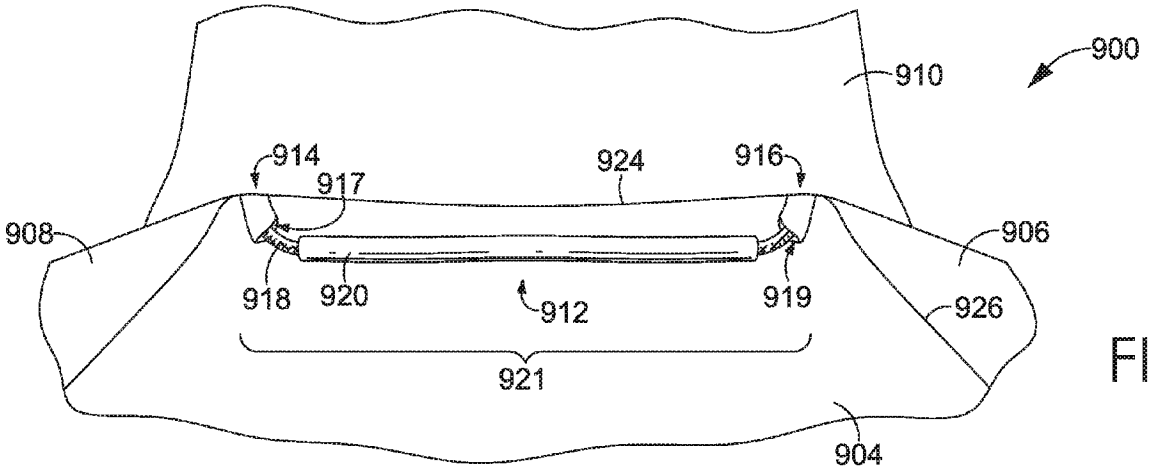
FIG. 9 illustrates an alternative configuration for an exemplary hood lock cord system in accordance with an aspect herein.

FIG. 9 illustrates another exemplary hood lock cord system 912 for an apparel item 900 in accordance with aspects herein. Similar to the hood lock cord system 212, the hood lock cord system 912 comprises a cord 918 having a first end 917, a second end 919, and an intervening portion 921 extending between the first end 917 and the second end 919. In exemplary aspects, the first end 917 is received into and secured to a first anchoring portion 914, and the second end 919 is received into and secured to a second anchoring portion 916. In this exemplary aspect, both the first anchoring portion 914 and the second anchoring portion 916 are secured at a seam 924 formed between the back panel 904 and the hood 910 of the apparel item 900.

Returning now to the hood lock cord system 212, other ways of affixing the hood lock cord system 212 to the outer-facing surface of the back panel 204 are contemplated herein. For instance, instead of using the first and second anchoring portions 214 and 216 to secure the hood lock cord system 212 to the apparel item 100 at the seams 716 and 718, the first end 710 and the second end 712 may be directly secured to the apparel item 100 at the seams 716 and 718. Or, with respect to FIG. 9, the first and second ends 917 and 919 of the cord 918 may be directed secured to the apparel item 900 at the seam 924 without use of the first and second anchoring portions 914 and 916. In another aspect, the first and second anchoring portions 214 and 216, or the first and second ends 710 and 712 of the cord 218, may be secured directly to the outer-facing surface of the back panel 204 via stitching, bonding, grommets, adhesives, and the like.

Figure 10:
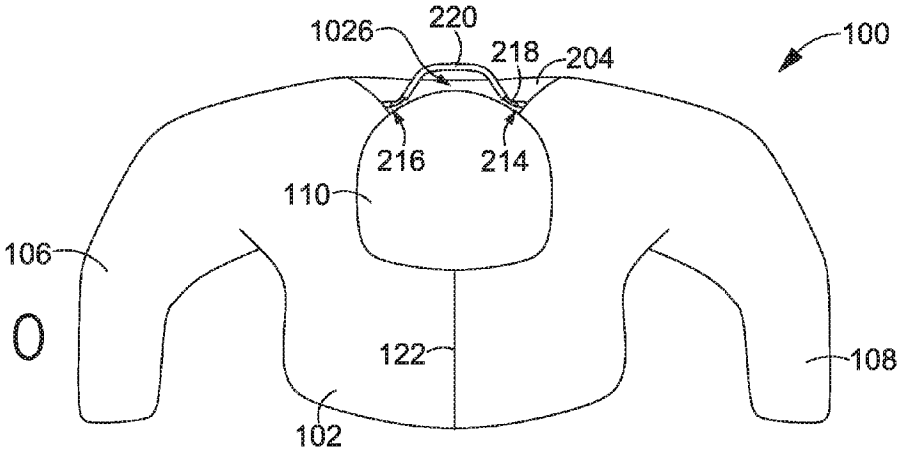
FIG. 10 illustrates a top view of the exemplary apparel item having the hood lock cord system of FIG. 1 in accordance with an aspect herein.

FIG. 10 illustrates a top view of the exemplary apparel item 100 having the hood lock cord system 212 in accordance with aspects herein. As seen in FIG. 10, in a resting or non-stretch state, the cord 218 may have a length such that a gap or space 1026 may be formed between the cord 218 and the back panel 204 prior to the cord 218 being stretched. By introducing a degree of laxity to the cord 218 of the hood lock cord system 212, the hood 110 may be more easily inserted under the cord 218 when not in use. This is in contrast to the cord 218 having a shorter length such that the space between the cord 218 and the back panel 204 is minimal or non-existent.

Figure 4:
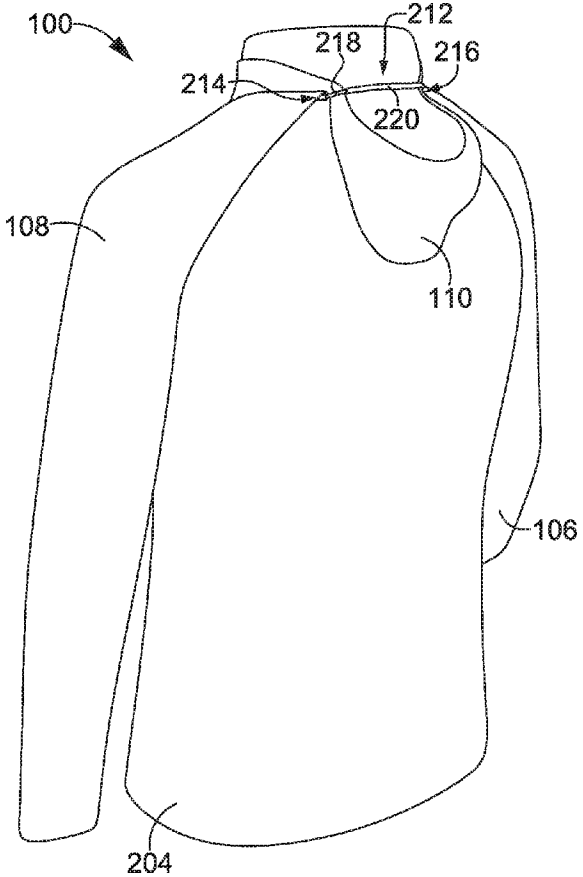
FIG. 4 illustrates a perspective back view of the exemplary apparel item having the hood lock cord system of FIG. 3 in accordance with an aspect herein.
Figure 3:
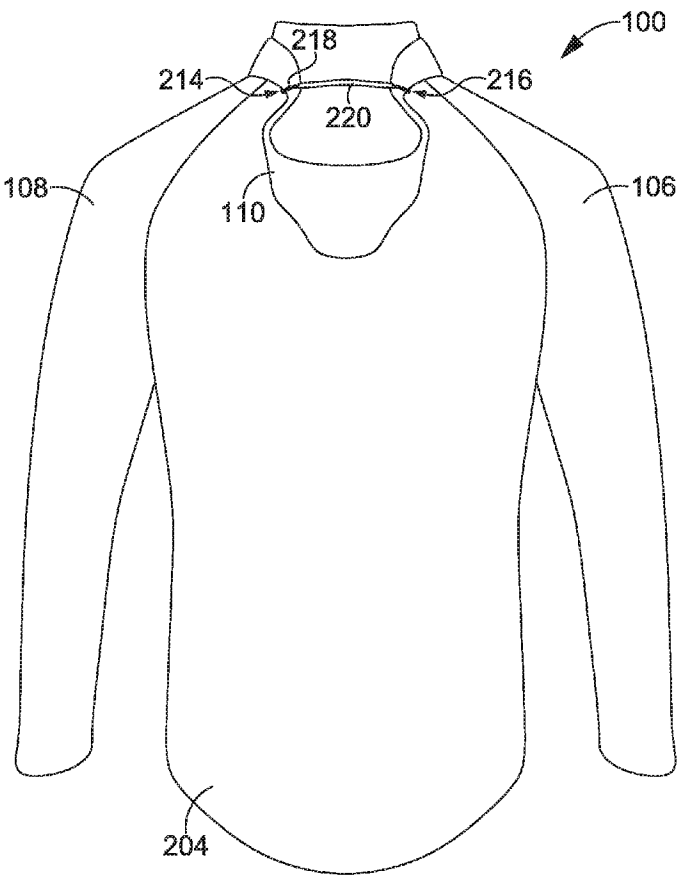
FIG. 3 illustrates a back view of the exemplary apparel item having the hood lock cord system of FIG. 2 where the hood is in a downward position in accordance with an aspect herein.

FIG. 3 illustrates a back view of the exemplary apparel item 100 having the hood lock cord system where the hood 110 is in a downward or un-worn configuration in accordance with an aspect herein. As shown in FIG. 3, the hood 110 has been secured to the apparel item 100 by inserting the hood 110 under the cord 218 of the hood lock cord system 212 such that at least a portion of the hood 110 is situated between the back panel 204 and the cord 218. The hood 110 shown in FIG. 3 has not been folded or bunched. In this manner, the hood 110 retains its full length, yet is more restricted than if the apparel item 100 did not comprise the hood lock cord system 212. FIG. 3 also illustrates the first anchoring portion 214, the second anchoring portion 216, and the sheath 220. As shown, use of the sheath 220 helps to prevent the cord 218 from coming into direct contact with the hood 110. This not only helps to protect the structural integrity of the cord 218 but also may facilitate the insertion of the hood 110 under the cord 218 as explained above. FIG. 4 illustrates a perspective back view of the exemplary apparel item 100 having the hood 110 in a downward position and secured to the apparel item using the hood lock cord system 212.

Figure 6:
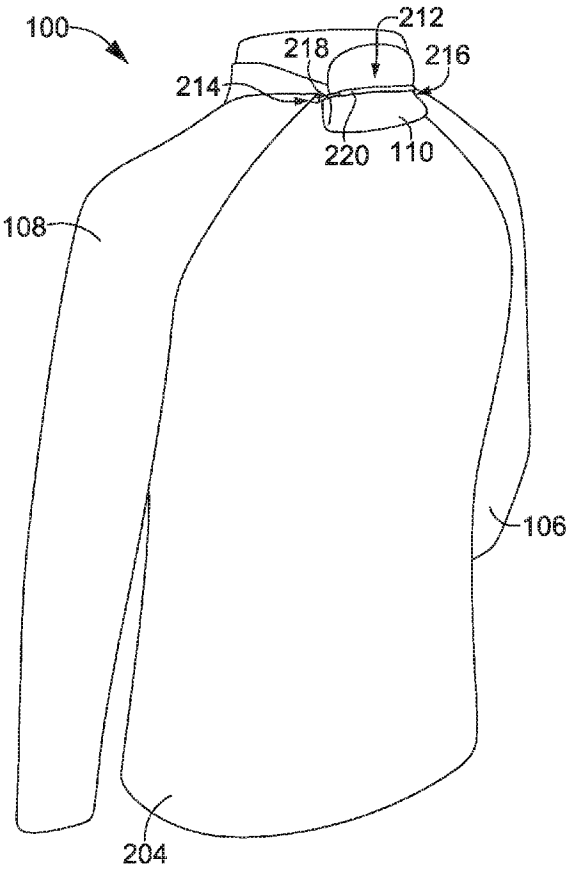
FIG. 6 illustrates a perspective back view of the exemplary apparel item having the hood lock cord system of FIG. 5 in accordance with an aspect herein.
Figure 5:
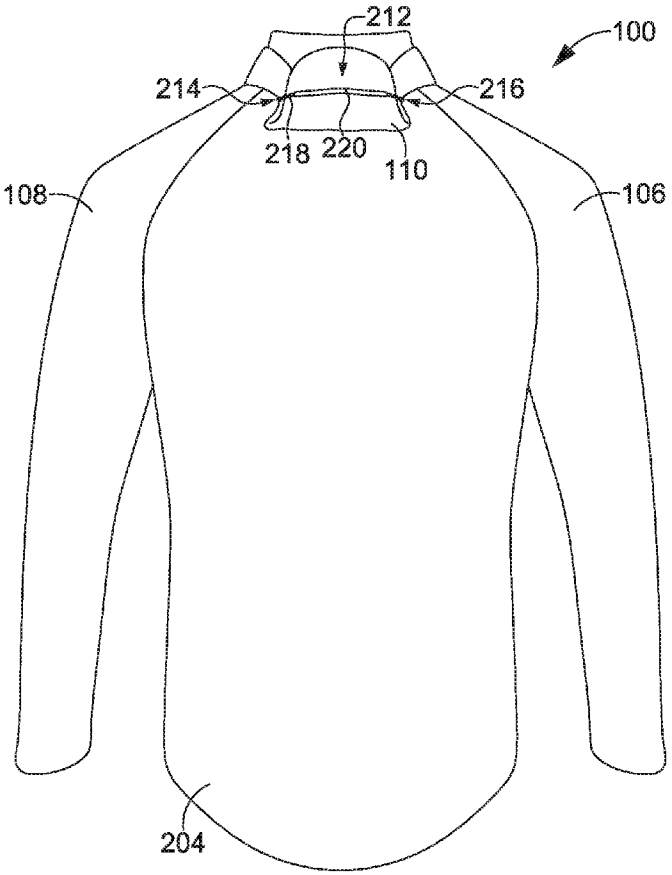
FIG. 5 illustrates a back view of the exemplary apparel item having the hood lock cord system of FIG. 2 where the hood is in a downward position in accordance with an aspect herein.

FIGS. 5 and 6 illustrate an additional way to utilize the hood lock cord system 212 in accordance with aspects herein. These figures illustrate a back view and a back perspective view respectively of the exemplary apparel item 100 having the hood 110 in a secured position. With respect to FIGS. 5 and 6, the hood 110 has been folded or bunched prior to being secured under the cord 218 of the hood lock cord system 212. By folding or bunching the hood 110 prior to securing the hood 110, the hood 110 is further restricted from exhibiting movement during the wearer's activities. This may be advantageous during especially vigorous activities. It is contemplated herein that the hood 110 may be secured via the hood lock cord system 212 in additional ways other than those shown in, for example, FIGS. 3-6.

Figure 11:
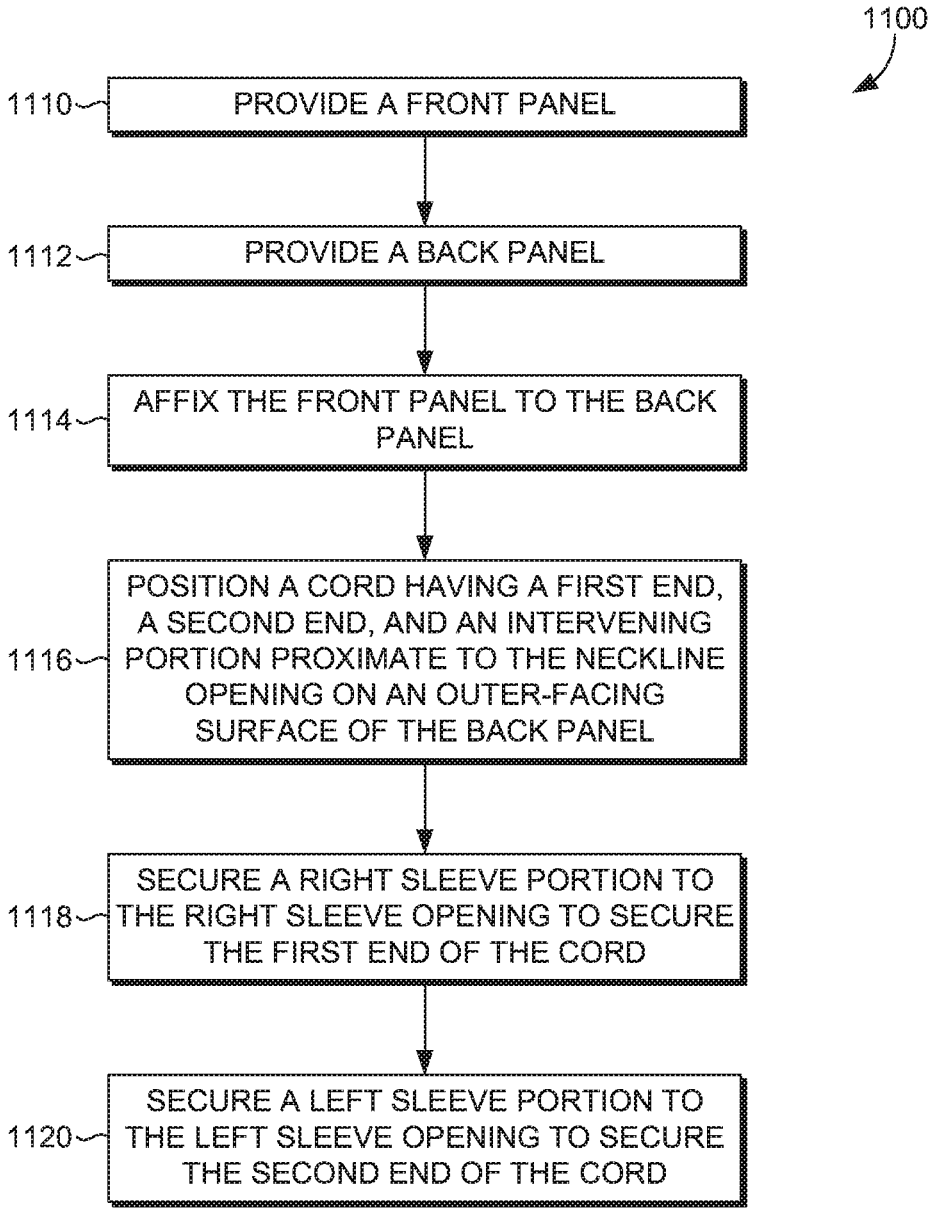
FIG. 11 illustrates a flow diagram of an exemplary method of manufacturing an apparel item having a hood lock cord system in accordance with an aspect herein.

FIG. 11 illustrates a flow diagram of an exemplary method 1100 of manufacturing an apparel item having a hood lock cord system, such as apparel item 100 in accordance with an aspect herein. At a step 1110, and at a step 1112, a front panel and a back panel are provided respectively. In accordance with aspects herein, the front panel and the back panel provided in steps 1110 and 1112 may be manufactured using textile or non-textile materials. Additionally, the front panel and the back panel provided in steps 1110 and 1112 may be formed through a knitting or weaving process.

From here, step 1114 comprises affixing the front panel to the back panel provided in steps 1110 and 1112, respectively using affixing technologies such as, for example, stitching, bonding, welding, adhesives, and the like. Once affixed, the front panel and back panel may define at least a neckline opening, a right sleeve opening, a left sleeve opening, and a waist opening for the apparel item. In an exemplary aspect, a hood may also be affixed to the neckline opening.

Continuing, at a step 1116, a cord having a first end, a second end, and an intervening portion is positioned proximate to the neckline opening on an outer-facing surface of the back panel such that the first end is positioned on a first lateral side of the back panel proximate the neckline opening, the second end is positioned on a second lateral side of the back panel proximate the neckline opening, and the intervening portion of the cord extends across a midline of the back panel. Continuing, at a step 1118, a right sleeve portion is secured to the right sleeve opening of the apparel item such that the first end of the cord is secured in the seam. In a similar manner, at step 1120, a left sleeve portion is secured to the left sleeve opening of the apparel item such that the second end of the cord is secured in the seam.

In an alternative method of manufacturing, the first and second ends of the cord may first be secured in a first and second anchoring portion respectively such as the first and second anchoring portions 214 and 216 of the hood lock cord system 212, and the anchoring portions may be secured in the seams joining the right and left sleeve portions to the back panel. In yet another alternative method of manufacturing, the first and second ends of the cord may be secured in a seam joining the hood portion to the apparel item, or, when the first and second ends are secured in the first and second anchoring portions, the first and second anchoring portions may be secured in the seam joining the hood portion to the back panel. Any and all aspects, and any variation thereof, are contemplated as being within the scope herein.

Aspects of the present invention have been described with the intent to be illustrative rather than restrictive. Alternative aspects will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

What is claimed is:

1. A hood lock cord system useable to secure a hood portion of an apparel item for an upper torso of a wearer when the hood portion is not in use, the hood lock cord system comprising:

a cord comprising a first end, a second end, and an intervening portion, the cord being positioned on an outer-facing surface of a back panel of the apparel item proximate to a neckline area of the apparel item such that the first end is secured to a first seam formed between a right sleeve panel and a first lateral side of the back panel, the second end is secured to a second seam formed between a left sleeve panel and a second lateral side of the back panel, and the intervening portion of the cord extends across a midline of the back panel proximate to the neckline area.

2. The hood lock cord system of claim 1, wherein the first end is secured to the first lateral side of the back panel via a first anchoring portion, and wherein the second end is secured to the second lateral side of the back panel via a second anchoring portion.

3. The hood lock cord system of claim 2, wherein the first anchoring portion is located at the first seam formed between the back panel and the right sleeve panel, and wherein the second anchoring portion is located at the second seam formed between the back panel and the left sleeve panel.

4. The hood lock cord system of claim 1, wherein the cord is made of a material with elastic properties.

5. The hood lock cord system of claim 1, wherein the cord further comprises a rubber or plastic sheath.

6. The hood lock cord system of claim 1, wherein a length of the cord is between 5 cm and 20 cm.

7. The hood lock cord system of claim of claim 1, wherein the cord is positioned up to 10 cm below the neckline area of the apparel item.

8. An apparel item having a hood lock cord system, the apparel item comprising:

a front panel;

a back panel affixed to the front panel at one or more seams, the front panel and the back panel defining at least a right sleeve opening and a left sleeve opening, a neckline opening, and a waist opening;

a hood attached to the neckline opening; and a hood lock cord system comprising:

a cord having a first end, a second end, and an intervening portion extending between the first end and the second end of the cord, the first end of the cord secured to a first seam formed between the right sleeve opening and a first lateral side of an outer-facing surface of the back panel, and wherein the second end of the cord secured to a second seam formed between the left sleeve opening and a second lateral side of the outer-facing surface of the back panel proximate to the neckline opening such that the intervening portion of the cord extends across a midline of the back panel, the cord useable to secure the hood when the hood is not being used.

9. The apparel item of claim 8, wherein the first end of the cord is secured to the first seam via a first anchoring portion, and wherein the second end of the cord is secured to the second seam via a second anchoring portion.

10. The apparel item of claim 9, wherein a cross-sectional shape of the cord comprises at least one of a circular, triangular, square, or a non-symmetrical shape.

11. The apparel item of claim 10, wherein the cross-sectional shape of the cord varies from the first anchoring portion to the second anchoring portion.

12. The apparel item of claim 9, wherein a diameter of the cord varies from the first anchoring portion to the second anchoring portion.

13. The apparel item of claim 8, wherein the cord further comprises a rubber or plastic sheath.

14. The apparel item of claim 8, wherein a length of the cord is between 5 cm and 20 cm.

15. The apparel item of claim 8, wherein the cord is positioned up to 10 cm below the neckline opening of the apparel item.

16. A method of manufacturing an apparel item having a hood lock cord system, the method comprising:

providing a front panel;

providing a back panel;

providing a right sleeve portion;

providing a left sleeve portion;

providing a cord having a first end, a second end, and an intervening portion extending between the first end and the second end;

affixing the front panel to the back panel to form in part the apparel item, wherein when affixed together, the front panel and the back panel define at least a right sleeve opening and a left sleeve opening, a waist opening, and a neckline opening;

affixing a hood portion to the neckline opening;

securing the first end of the cord in a first seam formed between the right sleeve portion and the right sleeve opening; and securing the second end of the cord in a second seam formed between the left sleeve portion and the left sleeve opening, wherein the cord is positioned on an outer-facing surface of the back panel proximate to the neckline opening, and wherein the intervening portion of the cord extends across a midline of the back panel.

17. The method of manufacturing of claim 16, wherein the first end of the cord is secured in the first seam via a first anchoring portion, and wherein the second end of the cord is secured in the second seam via a second anchoring portion.

18. The method of manufacturing of claim 16, wherein the cord further comprises a rubber or plastic sheath.

19. The method of manufacturing of claim 18, wherein the rubber or plastic sheath extends substantially along a length of the cord.

* * * * *